US006202796B1

(12) United States Patent
Lee

(10) Patent No.: US 6,202,796 B1
(45) Date of Patent: Mar. 20, 2001

(54) ELEVATOR POSITION CONTROLLING APPARATUS AND METHOD

(75) Inventor: Soo-Cheol Lee, Changwon (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/276,121

(22) Filed: Mar. 25, 1999

(30) Foreign Application Priority Data

Mar. 26, 1998 (KR) ..... 98-10555

(51) Int. Cl.[7] ..... B66B 1/28
(52) U.S. Cl. ..... 187/293; 187/284
(58) Field of Search ..... 187/289, 291, 187/293, 284

(56) References Cited

U.S. PATENT DOCUMENTS 3,589,474 * 6/1971 Wavre ..... 187/29 R
3,743,055 * 7/1973 Hoelscher et al. ..... 187/29 R
3,773,146 * 11/1973 Dixon, Jr. et al. ..... 187/29
3,777,855 * 12/1973 Boydew et al. ..... 187/29 R
4,553,640 * 11/1985 Inaba et al. ..... 187/29 R
4,570,755 * 2/1986 Tsai et al. ..... 187/29 R
4,658,935 * 4/1987 Holland ..... 187/122
5,421,432 * 6/1995 Strambi et al. ..... 187/288

* cited by examiner

*Primary Examiner*—Jonathan Salata
(74) *Attorney, Agent, or Firm*—Birch, Stewart, Kolash & Birch, LLP

(57) ABSTRACT

In a position controlling apparatus and method for an elevator which controls a position of an elevator in accordance with a velocity command profile consisting of an acceleration region, a uniform velocity region and a deceleration region, a position controlling apparatus and method according to the present invention controls generation of a synchronization position error in the deceleration region. The position controlling method for the elevator of the invention includes the steps of: determining a deceleration starting point of a deceleration profile region; previously storing a command position corresponding to the time elapsed after the deceleration starting point; dividing the command position into a plurality of position regions; differently establishing computing formulas of a velocity command by each position region; determining the position region to which the command position at a present time belongs; computing a second velocity command value in accordance with a time using the computing formula corresponding to the determined position region at the present time; and controlling a position of the elevator car in accordance with the second velocity command value after the deceleration starting point.

7 Claims, 6 Drawing Sheets

ELEVATOR POSITION CONTROLLING APPARATUS AND METHOD

BACKGROUND OF THE INVENTION

1. Field of the Invention

The present invention relates to a position controlling apparatus and method for an elevator, and more particularly to a position controlling apparatus and method for an elevator which minimizes a levelling error of a floor level and a car bottom level when an elevator arrives at an destination floor.

2. Description of the Conventional Art

FIG. 1 schematically illustrates a conventional elevator system. As shown therein, an elevator car 101 moves along an hoist way in a building and in the elevator car 101, there are provided with a plurality of destination floor selecting buttons (not shown) for a passenger to select a desired floor according to the number of elevator operating floors. Also, although not shown in the diagram, there are provided with a plurality of hall call buttons to supply a signal which indicates a hall call of a passenger on a hall of each floor. A counter weight 102 and the elevator car 101 are connected to each other by a rope of which an end is fixed to the counter weight 102 and the other end to the elevator car 101. A sheave 105 moves the elevator car 101 by winding or releasing the rope. An AC (alternating current) motor 106 is coupled to the sheave 105 for thereby driving the sheave 105, and an encoder 107 supplies a pulse signal corresponding to the rotation of the AC motor 106. In addition, a position detector 103 which is arranged on an upper surface of the elevator car 101 detects that the elevator car arrives at a previously determined position of each floor and outputs a signal indicating the detection. Further, a shielding board 104 is provided at a predetermined position of each floor to operate the position detector 103. Generally, a switching device such as a photo coupler, which has a light emitting unit and a light receiving unit, is used for the position detector 103. When the shielding board 104 which is positioned between the light emitting unit and the light receiving unit of the position detector 103 shields light, the switching device connected to the light receiving unit becomes on or off, thereby indicating the light shielding and accordingly indicating that the elevator car 101 has arrived at the predetermined floor. Here, an output signal of the position detector 103 is transmitted to an operation controller 108. The operation controller 108 determines a floor for the elevator car 101 to serve, when it receives hall call signal or a car call signal from one of the hall call buttons or the destination floor selecting buttons. Then, the operation controller 108 computes a distance-to-go in accordance with a distance of a present floor from a base floor for example a 1st floor and a distance of a destination floor from said base floor, and outputs velocity command signal corresponding to the computed distance-to-go.

The motor controller 109 outputs a current control signal or a voltage control signal corresponding to the velocity command signal from the controller 108. Since the current control signal or the voltage control signal from the motor controller 109 is a direct current signal or a direct voltage signal, when an alternating current motor is used as a driving motor for an elevator, above said direct current signal or direct voltage signal is outputted to the motor 106 via an inverter 110. The inverter 110 outputs an alternating control signal having variable amplitude and frequency to the motor 106 correspondingly to the control output of the motor controller 109.

In order to monitor whether a velocity and position of a car is being controlled correspondingly to said velocity command signal, pulse signal indicating rotation and rotating direction from said encoder 107 is fed back to said motor controller 109.

Here, in the conventional art, a technique of generating the velocity command signal by the operation controller 108 has several methods.

A first method is to multiply the distance to go by a gain value. However, according to the method, it is difficult to compute an accurate gain value because the distance and the velocity have different units, and such a method has a problem that the gain value should be always adjusted because the gain value varies in accordance with the motor, load of the elevator car, a standard speed thereof and kinds of traction machine (including a motor, a decelerator and a sheave).

A second method is to calculate a velocity command value using the formula, that is, the velocity command value=a current velocity command value+gain (a previous velocity command value−feedback speed). However, since such a method is to control actual speed of the elevator to follow the velocity command, it is more suitable to the controlling of the speed of the elevator, rather than the controlling of the position thereof, and also, similarly to the above first method, the problem of the adjusting of the gain still can not be solved.

Third, there is provided a method which computes a velocity command, corresponding to a distance-to-go, to follow velocity profiles of an acceleration profile region, a uniform velocity profile region and a deceleration profile region and, when having a synchronization position error between a position of the elevator car obtained by counting a pulse number of the encoder and an actual position thereof obtained by the position detector, obtaining a new distance-to-go by adding the error to the previous distance-to-go, and on the basis of the newly obtained distance-to-go computing a new velocity command value in ranges of only the acceleration profile region and the uniform velocity profile region. Such a method suggested by the applicant of the invention in U.S. Pat. No. 5,896,950. However, it is impossible to solve the problem of having a difference between a bottom level of the elevator car and a level of a landing in the arrival of the elevator at the desired floor, since according to this method when the synchronization position error is produced in the deceleration profile region, the error can not be corrected.

Lastly, there is a method for obtaining the velocity command value which sets up a database of a synchronization position error quantity with respect to an entire velocity region including the acceleration profile region, the uniform velocity profile region and the deceleration profile region by each item of the load, the moving direction, the starting floor and the stopping floor of the elevator car, and then continuously updating the database while operating the elevator. Such a method may solve a problem of a levelling error in the arrival of the desired floor due to the synchronization location error to the entire velocity profile region. But, a memory of a large capacity is required to accomplish the above method, and a complex program should be operated in order to correct the error and update the database, which results in high possibility of having an erroneous operation due to bugs or noises of the program.

SUMMARY OF THE INVENTION

Accordingly, the present invention is directed to a position controlling apparatus and method for an elevator which obviates the problems and disadvantages due to the conventional art.

An object of the present invention is to provide a position controlling apparatus and method for an elevator that does not need to adjust a gain.

Another object of the present invention is to provide a position controlling apparatus and method for an elevator that solves a problem of having an error of a synchronous position which is generated in a deceleration area.

Still another object of the present invention is to provide a position controlling apparatus and method for an elevator that does not need a database of a large capacity.

To achieve the above object, an embodiment according to the present invention provides a position controlling apparatus for an elevator for controlling a position of an elevator car which is driven by torque of a motor and moves along a hoistway in a building. The position controlling apparatus includes:

an encoder for outputting a pulse signal which corresponds to the rotation of the motor, a position detector disposed at an upper part of the elevator car for detecting arrival of the elevator car at a predetermined position of each floor and outputting a floor identifying signal of each floor, a travelled-distance computing means for computing and outputting a distance for which the elevator car has travelled in accordance with the pulse signal supplied from the encoder. The position controlling apparatus also includes, a destination floor determining means for outputting a signal which identifies a destination floor to which the elevator travels, a floor distance storing means for storing distance data from a predetermined base floor to each of respective floors in accordance with an output of the travelled-distance operation means, a distance-to-go operating means for, responding to the destination floor identifying signal outputted from the destination floor determining means, computing and outputting a distance-to-go from a present floor to the destination floor according to the distance data supplied from the floor distance storing means and the distance data of the present floor outputted from the floor distance storing means, being indicated by the identifying signal of the present floor supplied from the position detector, a first velocity command generating means for generating and outputting a first velocity command signal which follows a velocity profile having an acceleration region, a uniform velocity region and a deceleration region, corresponding to the distance-to-go output supplied from the distance-to-go computing means, a floor distance correcting means for computing a distance of each floor dependent upon the travelled distance supplied from the travelled-distance computing means whenever receiving the floor identifying signal from the position detector, comparing the computed distance value of each floor with the distance data value of the corresponding floor supplied from floor distance storing means and, if there is a difference between the compared distance values, storing the newly computed distance in the floor distance storing means as the distance data for the corresponding floor, a deceleration starting point determining means for determining and outputting a deceleration starting point, depending upon the first velocity command signal outputted from the first velocity command generating means, a second velocity command generating means for, if there is an output from the deceleration starting point determining means, computing a second velocity command value of the deceleration region and outputting the resultant value as a second velocity command signal, corresponding to the command position of the elevator car which has been stored by each predetermined time elapsed since the deceleration starting point, a signal switching means for outputting the second velocity command signal if there is the output of the second velocity command signal from the second velocity command generating means, and outputting the first velocity command signal supplied from the first velocity command generating means if there is no output of the second velocity command signal, and a motor controller for outputting a motor control signal in accordance with the output from the signal switching means.

Also, to achieve the above objects of the present invention, there is provided a method for controlling a position of an elevator car by generating a first velocity command signal to follow a velocity profile which has an acceleration profile region corresponding to a linear function profile of a time during which a speed decreases in accordance with the time elapsed, a uniform velocity profile region maintaining a velocity value of an end point of the acceleration profile region and a deceleration profile region wherein the speed decreases from the uniform velocity value of the uniform velocity profile region to zero in accordance with the time elapsed, the improved elevator position controlling method includes the steps of:

determining a deceleration starting point of the deceleration profile region, previously storing a command position corresponding to the time elapsed after the deceleration starting point, dividing the command position into a plurality of position regions. The method further includes the steps of, differently establishing computing formulas of a velocity command by each position region, determining the position region to which the command position at a present time belongs, computing a second velocity command value in accordance with a time using the computing formula corresponding to the determined position region at the present time; and controlling a position of an elevator car in accordance with the second velocity command value after the deceleration starting point.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention, wherein.

DETAILED DESCRIPTION OF THE PREFERRED EMBODIMENTS

Reference will now be made in detail to the preferred embodiments of the present invention, examples of which are illustrated in the accompanying drawings.

Figure 2:
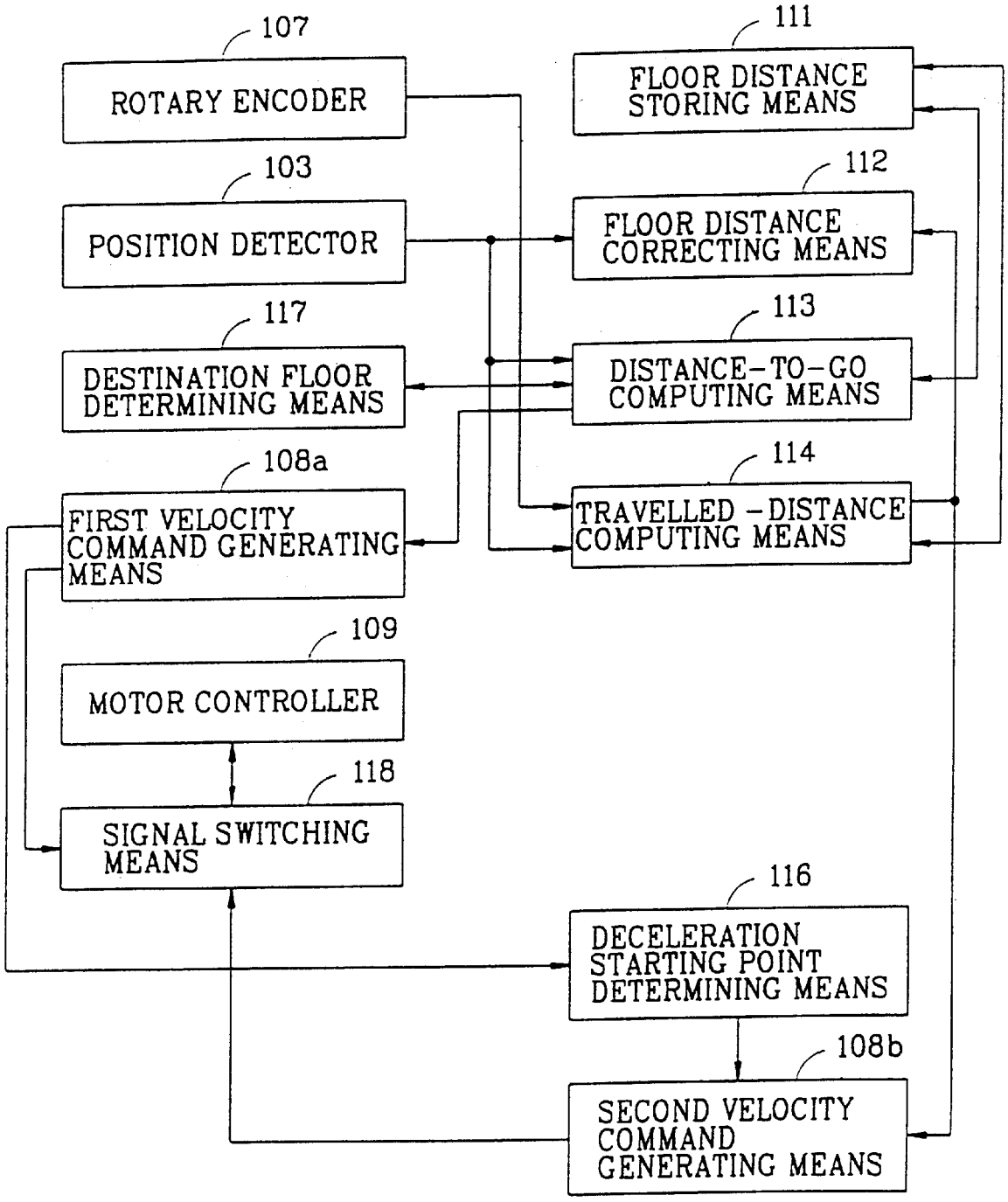
FIG. 2 is a block diagram of a position controlling apparatus for an elevator according to the present invention.

FIG. 2 is a block diagram of a position controlling apparatus for an elevator according to the present invention. As shown therein, a rotary encoder 107 outputs a pulse signal corresponding to the rotation of a motor 106, and an output of the rotary 107 is connected with an input of a travelled-distance computing means 114 which counts a pulse signal outputted from the rotary encoder 107, thereby computing a travelled distance of the elevator car 101 corresponding to the rotation number of the motor, the travelled distance of the elevator car 101 computed by the travelled-distance computing means 114 being transmitted to a floor distance storing means 111, a floor distance correcting means 112 and a second velocity command generating means 108*b*.

Figure 1:
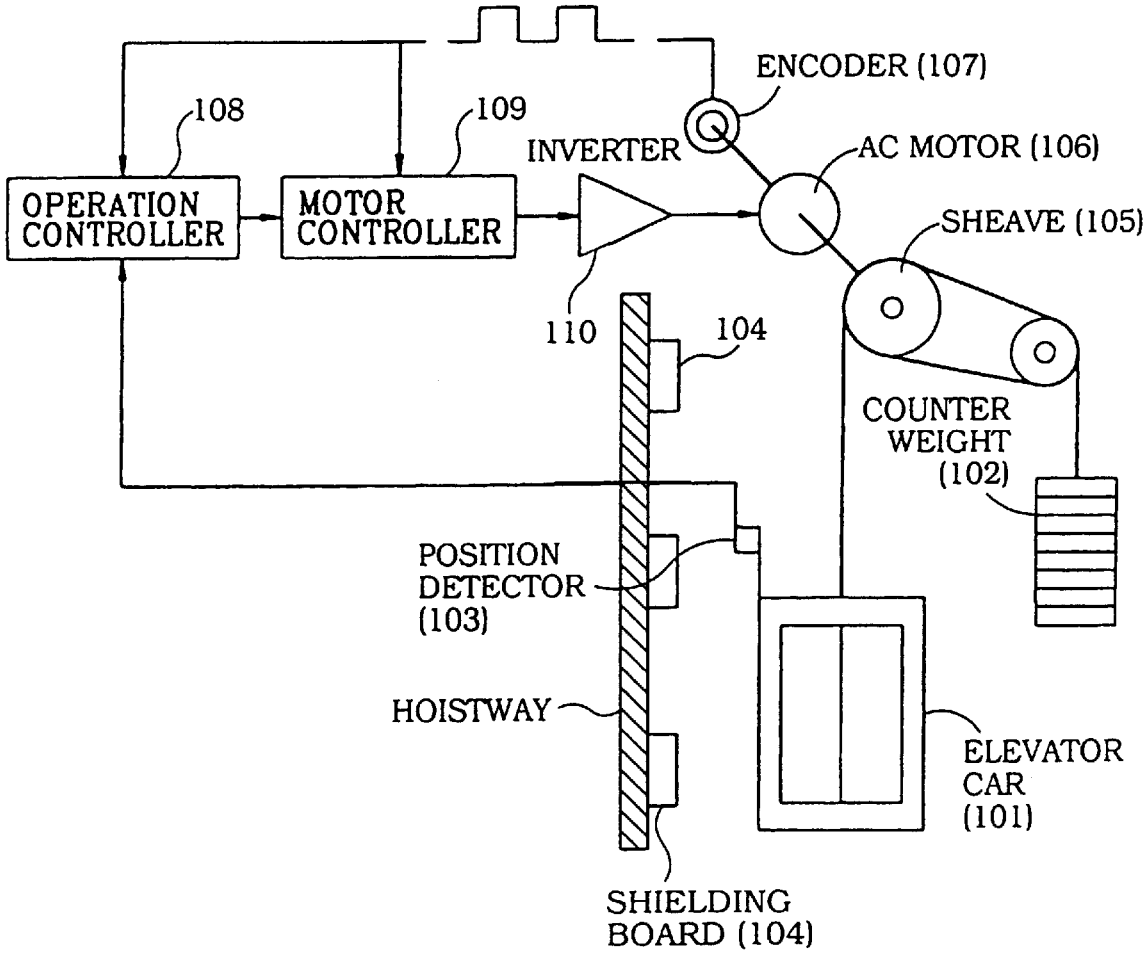
FIG. 1 CONVENTIONAL ART
FIG. 1 is a schematic diagram of a conventional elevator system.

While, the position detector 103, as shown in FIG. 1, arranged on the upper part of the elevator car 101, is operated by the shield board 104 provided at the predetermined position of each floor, onto a wall of the hoist way, and outputs an on or off signal to the floor distance correcting means 112 and the travelled-distance computing means 114.

A destination floor determining means 117, connected with hall call buttons (not shown) arranged at the hall of each floor or destination floor selecting buttons (not shown) installed in the elevator car 101, determines a floor selected by a user staying in the elevator car 101 or on the hall and transmits a determined destination floor identifying signal to a distance-to-go computing means 113. Further, an input of the distance-to-go computing means 113 is coupled with an output of the floor distance storing means 111. When receiving the destination floor identifying signal from the destination floor determining means 117, the distance-to-go computing means 113 reads from the floor distance storing means 111 the pulse number from the base floor, such as the 1st floor, to the destination floor, to the rotary encoder 107, that is distance data for each floor and reads from the floor distance storing means 111 the distance data of a present floor indicated by an identifying signal to the present floor which is outputted from the position detector 103, for thereby computing the distance to go from the following formula.

$$\text{Distance to go (D)} = |\text{destination floor distance} - \text{present floor distance}|$$

That is, the value of the distance-to-go (D) can be obtained by having an absolute value by subtracting the distance from the base floor to the present floor from the distance from the base floor to the destination floor. Further, the obtained distance value is transmitted to a first velocity command generating means 108*a*.

The floor distance storing means 111 is coupled with the floor distance correcting means 112 and the travelled-distance computing means 114. Accordingly, the floor distance storing means 111 stores a distance of each floor using travelled distance data outputted from the travelled-distance computing means 114, whenever receiving the on or off signal from the position detector 103 arranged on the car 101. In other words, when initially testing the elevator for its computation, the floor distance storing means 111 receives and stores the distance of each floor from the travelled-distance computing means 114 while upwards and downwards operating the elevator to a highest or lowest floor from the base floor.

While, the elevator is, as shown in FIG. 1, moves upwards and downwards the elevator car 101 and the counter weight 102 which are connected with each other by the rope by which the rotatable sheave 105 connected with the motor 105 winds or releases the rope. However, when a slip is generated between the rope and the sheave 105, the actual position of the elevator car 101 and the computed position thereof obtained by counting the pulse signal of the rotary encoder 107 may be different, the difference being referred as a synchronization error. Such an error results in a level difference between a landing level of the destination floor and a bottom level of the elevator car 101 and further if the level difference exceeds certain limits, it may be quite dangerous for the passenger to step on the landing of the destination floor. Accordingly, in order to eliminate the level difference exceeding the certain limits, whenever the position detector 103 operates, the floor distance correcting means 112 adds the distance from the base floor to the starting floor to the distance to go outputted from the distance-to-go computing means 113 and then stores the newly computed floor distance data of the corresponding floor in the floor distance storing means 111.

Further, the first velocity command generating means 108*a*, connected the output of the distance-to-go computing means 113, receives data of the distance to go to the destination floor from the distance-to-go computing means 113. Dependent upon the received data from the distance-to-go computing means 113, the first velocity command generating means 108*a* computes a velocity profile in accordance with time, as shown in FIG. 4, and continuously outputs a velocity command signal, corresponding to the computed velocity profile, to a signal switching means 118 and a deceleration starting point determining means 116.

Figure 3:
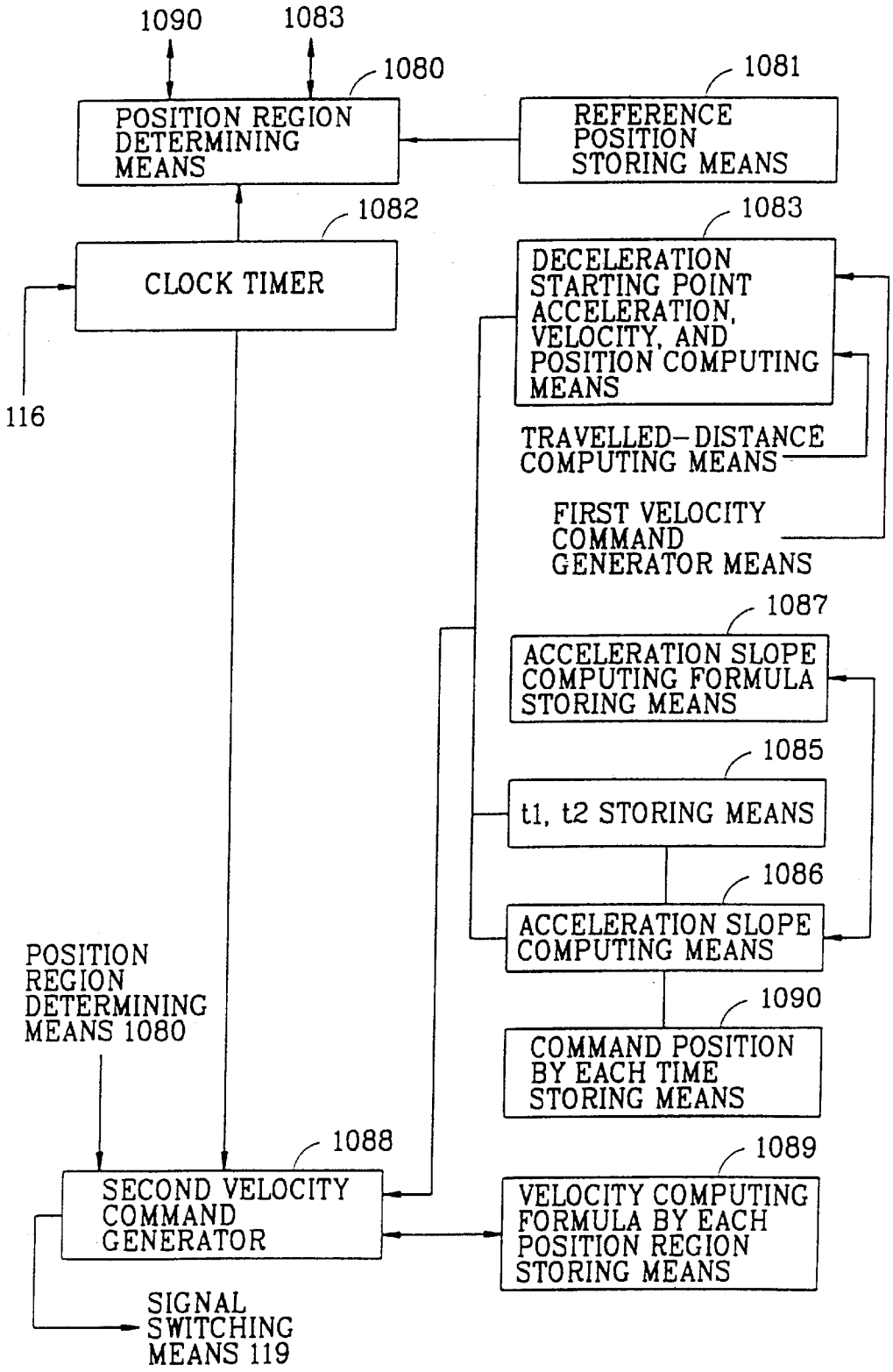
FIG. 3 is a detailed block diagram of a second velocity command generating means of FIG. 2.
Figure 4:
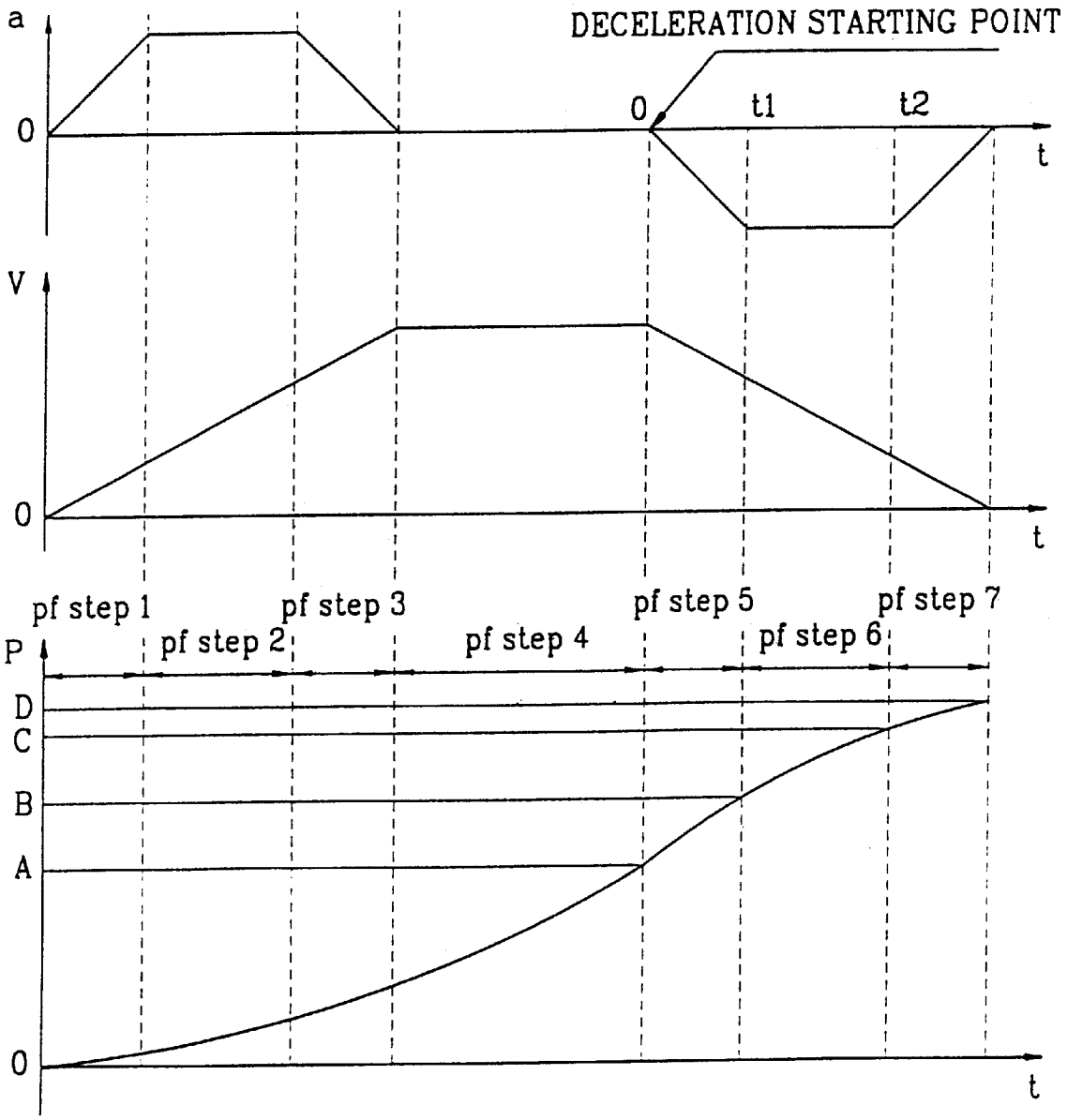
FIG. 4 is a diagram of a profile illustrating acceleration, velocity and position according to the present invention.

In addition, at a deceleration starting point, that is the deceleration starting point shown in FIG. 4, the deceleration starting point determining means 116 determines the deceleration starting point in accordance with the first velocity command signal outputted from the first velocity command generating means 108*a*. In other words, the deceleration starting point determining means 116 compares a value of the velocity command signal which has been previously received with a value of the presently received velocity command signal and determines as the deceleration starting point at the point of time when the value of the velocity command signal which has been previously received is greater than the value of the presently received velocity command signal and outputs a signal which indicates the deceleration starting point to the second velocity command generating means 108*b* which, after the deceleration starting point, computes by each predetermined time a new velocity command value corresponding to a car command position which has been previously set and stored and outputs a second velocity command signal with respect to the computed velocity command value. Referring to FIGS. 3 and 4, the configuration and computation of the second velocity command generating means 108*b* according to the preferred embodiment of the present invention will be explained in more detail.

If a velocity command output signal is supplied from the second velocity command generating means 108*b*, the signal switching means 118 connected with the outputs of the first and second velocity command generating means 108*a*, 108*b*, switches the velocity command signal outputted from a motor controller 109 to the velocity command output signal of the second velocity command generating means 108*b*. While, if no velocity command output signal is supplied from the second velocity command generating means 108*b*, the signal switching means 118 outputs to the motor controller 109 a velocity command signal of the first velocity command generating means 108*a*.

Here, it is to be noted that the motor controller 109 which has the same configuration as the motor controller 109 in FIG. 1 outputs to the inverter 110 a control output signal corresponding to the velocity command output signal supplied through the signal switching means 118 from the first 108*a* or second velocity command generating means 108*b*.

In FIG. 3, a reference position storing means 1081 stores a distance value of which the elevator car 101 has travelled after the deceleration starting point, that is values of reference positions A, B, C and D with respect to the present position of the elevator car 101, as shown in FIG. 4, wherein A<B<C<D, and the reference position A indicates the position of the elevator car 101 at the deceleration starting point. Here, supposing that the time of the deceleration starting point is 0, a value of the reference position A becomes 0.

While, as shown in FIG. 4, a value of the reference position B is a command position value of the elevator car 101 after the deceleration starting point, corresponding to an end point of a region of a linear function waveform in which an acceleration profile decreases from 0 while having a negative slope. A value of the reference position C is a command position value of the elevator car 101 after the deceleration starting point, corresponding to an end point of a region wherein the profile uniformly maintains a negative value. Further, also as shown in FIG. 4, a value of the reference position D is a command position value of the elevator car 101 after the deceleration starting point, corresponding to an end point of an region of a linear function waveform in which the profile increases from the uniform negative value, having a positive slope.

Taking into account the position of the elevator car 101 before the deceleration starting point, that is the distance from the starting floor to the deceleration starting point, the reference position A can be the distance from the starting floor which has been read from the travelled-distance computing means 114 to the deceleration starting point. Also, the values of the reference positions B, C and D can be respectively applied by adding the distance from the starting floor to the deceleration starting point to the travelling distance after the deceleration starting point.

A position region determining means 1080 responds a deceleration starting point determining output signal of the deceleration starting point determining means 116, thereby receiving from a clock timer 1082 a time count value after the deceleration starting point and reads a command position value stored in a command position value by each time storing means 1090 in accordance with the time count value, for thereby respectively comparing the four reference positions and size thereof which haven been read from the reference position storing means 1081 and thus determining a position region which includes the present command position.

That is, as shown in FIG. 4, if a position where the elevator car 101 should be presently positioned, that is a present command position is greater than the reference value A and is the same as the reference value B or less, it is determined that the present command position belongs to a region pf_step 5. While, if the present command position is greater than the reference value B and is the same as the reference value C or less, it is determined that the present command position belongs to a region pf_step 6, and if the present command position is greater than the reference value C and is the same as the reference value D or less, it is determined that the present command position belongs to a region pf_step 7. Here, it is noted that excepting the above conditions, the present command position is determined to be placed out of the deceleration region, and thus the computation of the second velocity command value is completed. Further, the clock timer 1082 is reset by the deceleration starting point determining output signal outputted from the deceleration starting point determining means 116, and counts and outputs the time elapsed after the deceleration starting point.

In addition, a deceleration starting point acceleration, velocity and position computing means 1083 is connected with the deceleration starting point determining means 116, the first velocity command generating means 108*a* and the travelled-distance computing means 114 of FIG. 2. Accordingly, while receiving the output signal indicating the deceleration starting point from the deceleration starting point determining means 116, the deceleration starting point acceleration, velocity and position computing means 1083 simultaneously receives the velocity command signal from the first velocity command generating means 108*a*, thereby determining the velocity value indicated by the velocity command signal as a velocity value $V_0$ of the deceleration starting point, determining the acceleration of the deceleration starting point as an acceleration value $A_0$ of the deceleration starting point which is obtained by computing a rate of change in accordance with the time elapsed with respect to a difference between the velocity before the deceleration starting point and the velocity value $V_0$ and obtaining a position $P_0$ of the deceleration starting point from the travelled distance outputted from the travelled-distance computing means 114.

While, the acceleration, the velocity and the position of the elevator car corresponding to the deceleration region of FIG. 4, that is the respective regions of pf_step 5, pf_step 6 and pf_step 7 can be expressed in the following formulas.

$$a_{5(t)}=-Jt+A_0 \quad (1)$$

$$a_{6(t)}=-Jt_1+A_0 \quad (2)$$

$$a_{7(t)}=-Jt_1+A_0+Jt \quad (3)$$

where, t is a predetermined time after the deceleration starting point, $t_1$ is a starting point of the region wherein the acceleration profile of FIG. 4 uniformly maintains the negative value, J is a slope of the region where the acceleration is displayed as the linear function of the predetermined time t, $A_0$ is an acceleration value of the deceleration starting point, $a_{5(t)}$ is an acceleration value of the region pf_step 5, $a_{6(t)}$ is an acceleration value of the region pf_step 6 and $a_{7(t)}$ is an acceleration value of the region pf_step 7.

Referring to FIG. 4, the above formulas 1 through 3 will now be explained in more detail.

That is, since the velocity region is the deceleration region, in the region pf_step 5 the acceleration profile is expressed in a linear function of the time t, which decreases and has the slope J of a negative value, and since the starting point is the deceleration starting point, the acceleration value $A_0$ of the deceleration starting point is added to the acceleration profile of the region pf_step 5. Further, in the region pf_step 6, the acceleration profile uniformly maintains the acceleration value at the time $t_1$, which corresponds to the starting point thereof, and since the time $t_1$ corresponds to the end point of the region pf_step 5, it can be expressed by substituting the time $t_1$ for t of the formula (1). In addition, in the region pf_step 7 the acceleration profile has the linear function type at the time t, which gradually increases and has the slope J of a positive value. Also, since the starting point of the acceleration profile in the region pf_step 7 is the end point of the region pf_step 6, it is possible to add $Jt_1$ to $-Jt_1+A_0$.

Next, velocity values V5(t), V6(t) and V7(t) of the regions pf_step 5, pf_step 6 and pf_step 7, respectively, can be expressed as the following formulas.

$$V_5(t)=-\tfrac{1}{2}Jt^2+A_0t+V_0 \quad (4)$$

$$V_6(t)=-Jt_1t+A_0t-\tfrac{1}{2}Jt_1^2+A_0t_1+V_0 \quad (5)$$

$$V_7(t)=-Jt_1t+A_0t+\tfrac{1}{2}Jt^2-Jt_1t_2+A_0t_2-\tfrac{1}{2}Jt_1^2+A_0t_1+V_0 \quad (6)$$

More particularly, since an initial velocity of $V_5(t)$ is $V_0$ of the deceleration starting point, $V_5(t)=-\tfrac{1}{2}Jt^2+A_0t+V_0$ is obtained by integrating $a_{5(t)}$ of the region pf_step 5 with respect to the time t. Further, since an initial velocity of $V_6(t)$ is identical to the velocity $V_5(t)$ at the time $t_1$, as shown in FIG. 4, $V_6(t)=-Jt_1t+A_0t-\tfrac{1}{2}Jt_1^2+A_0t_1+V_0$ can be obtained by integrating $a_{6(t)}$ of the region pf_step 6 with respect to the time t. Lastly, since an initial velocity of $V_7(t)$ is identical to the velocity $V_6(t)$ at the time $t_2$, as shown in FIG. 4, $V_7(t)=-Jt_1t+A_0t+\tfrac{1}{2}Jt^2-Jt_1t_2+A_0t_2-\tfrac{1}{2}Jt_1^2+A_0t_1+V_0$ can be obtained by integrating the acceleration value $a_{7(t)}$ of the region pf_step 7 with respect to the time t.

Next, position values P5(t), P6(t) and P7(t) of the regions pf_step 5, pf_step 6 and pf_step 7, respectively, can be expressed as the following formulas.

$$P_5(t)=-\tfrac{1}{6}Jt^3+\tfrac{1}{2}A_0t^2+V_0t+P_0 \quad (7)$$

$$P_6(t)=-\tfrac{1}{2}Jt_1t^2+\tfrac{1}{2}A_0t^2-\tfrac{1}{2}Jt_1^2t+A_0t_1t+V_0t-\tfrac{1}{6}Jt_1^3+\tfrac{1}{2}A_0t_1^2+V_0t_1+P_0 \quad (8)$$

$$P_7(t)=-\tfrac{1}{2}Jt_1t^2+\tfrac{1}{2}A_0t^2+\tfrac{1}{6}Jt^3-Jt_1t_2t+A_0t_2t-\tfrac{1}{2}Jt_1^2t+A_0t_1t+V_0t-\tfrac{1}{2}Jt_1t_2^2+\tfrac{1}{2}A_0t_2^2-\tfrac{1}{2}Jt_1^2t_2+A_0t_1t_2+V_0t_2-\tfrac{1}{6}Jt_1^3+\tfrac{1}{2}A_0t_1^2+V_0t_1+P_0 \quad (9)$$

Particularly, since an initial position of $P_5(t)$ is $P_0$ of the deceleration starting point, $P_5(t)=-\tfrac{1}{6}Jt^3+\tfrac{1}{2}A_0t^2+V_0t+P_0$ is obtained by integrating $V_5(t)$ of the region pf_step 5 with respect to the time t. Further, since an initial position of $P_6(t)$ is identical to the position $P_5(t)$ at the time $t_1$, as shown in FIG. 4, $P_6(t)=-\tfrac{1}{2}Jt_1t^2+\tfrac{1}{2}A_0t^2-\tfrac{1}{2}Jt_1^2t+A_0t_1t+V_0t-\tfrac{1}{6}Jt_1^3+\tfrac{1}{2}A_0t_1^2+V_0t_1+P_0$ can be obtained by integrating $V_6(t)$ of the region pf_step 6 with respect to the time t, and since an initial position of $P_7(t)$ is identical to the position $P_6(t)$ at the time $t_2$, as shown in FIG. 4, $P_7(t)=-\tfrac{1}{2}Jt_1t^2+\tfrac{1}{2}A_0t^2+\tfrac{1}{6}Jt^3-Jt_1t_2t+A_0t_2t-\tfrac{1}{2}Jt_1^2t+A_0t_1t+V_0t-\tfrac{1}{2}Jt_1t_2^2+\tfrac{1}{2}A_0t_2^2-\tfrac{1}{2}Jt_1^2t_2+A_0t_1t_2+V_0t_2-\tfrac{1}{6}Jt_1^3+\tfrac{1}{2}A_0t_1^2+V_0t_1+P_0$ can be obtained by integrating $V_7(t)$ of the region pf_step 7 with respect to the time t.

While, a $t_1$, $t_2$ storing means 1085 stores $t_1$, $t_2$, which are respectively a start point and an end point of constant acceleration in the deceleration region. Here, the start point of the constant acceleration is the end point of the region where the acceleration decreases and the end point thereof is the region where the acceleration increases. The command position value by each time storing means 1090 is a storing means which stores by the predetermined time a position command value of the elevator car after the deceleration starting point, where the command position of the elevator car 101 stored by each time is a value of which the distance that the elevator car 101 should travel in accordance the time elapsed, that is a command position value of the elevator car 101 is previously set and stored. According to the present invention, an acceleration slope computing formula storing means 1087 stores the formula (9), but it is also possible that the formulas (7), (8) are stored in the acceleration slope computing formula storing means 1087.

Further, an acceleration slope computing means 1086 reads the command position from the command position value by each time storing means 1090, $t_1$, $t_2$ from the $t_1$, $t_2$ storing means 1085, $A_0$, $V_0$ and $P_0$ of the deceleration starting point from the deceleration starting point acceleration, velocity and position computing means 1083 and the acceleration slope computing formula from the acceleration slope computing formula storing means 1087, and obtains a value of acceleration slope J by getting a solution of an equation of the acceleration slope J by substituting $t_1$ for t and the received values for the formula (9). Thus, the formula can be $P_7(t_1)=-Jt_1^3+2A_0t_1^2+2A_0t_1t_2-\tfrac{3}{2}Jt_1^2t_2-\tfrac{1}{2}Jt_1t_2^2+\tfrac{1}{2}A_0t_2^2+2V_0t_1+V_0t_2+P_0$.

In addition, a velocity computing formula by each position region storing means 1089 stores the formulas (4)–(6), that is the velocity computing formulas by each position region, and an output thereof is connected with a second velocity command generator 1088 which reads from the velocity computing formula by each position region storing means 1089 one of the formulas (4)–(6), that is the velocity computing formula corresponding to the position region outputted from the position region determining means 1080 and substitutes for the position region velocity computing formula which has been read a value of the time t supplied from the clock timer 1082, the acceleration slope J supplied from the acceleration slope computing means 1086, $A_0$, $V_0$ supplied from the deceleration starting point acceleration, velocity and position computing means 1083 and $t_1$, $t_2$ supplied from the $t_1$, $t_2$ storing means 1085, for thereby obtaining a velocity command value of the present position. Accordingly, the second velocity command generator 1088 outputs the velocity command value of the present position of the elevator car in accordance with the position region to the signal switching means 118.

While, referring to FIGS. 5 and 6, the position control method of the elevator according to the present invention will now be explained.

Figure 5:
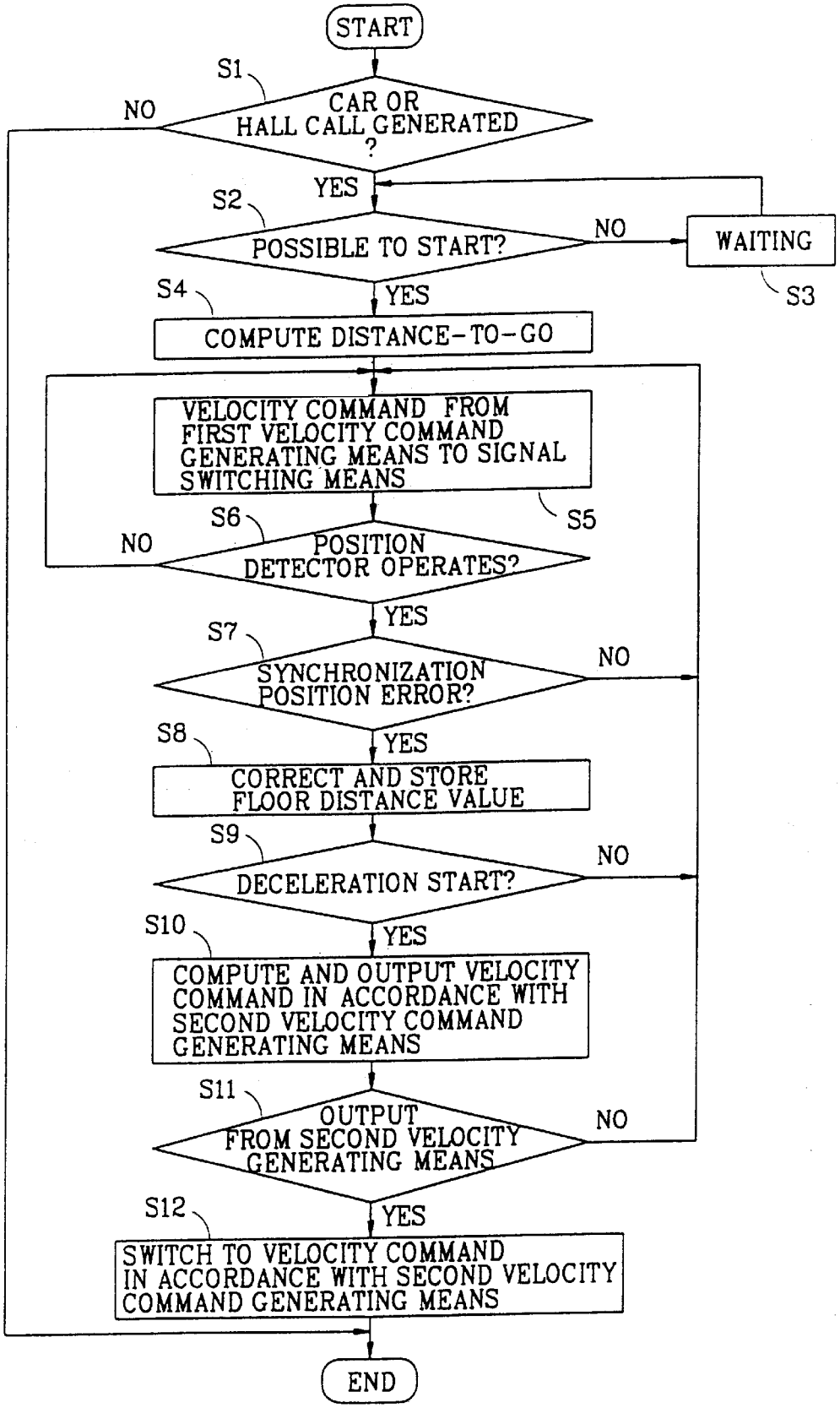
FIG. 5 is a flowchart of a position controlling method for an elevator according to the present invention.
Figure 6:
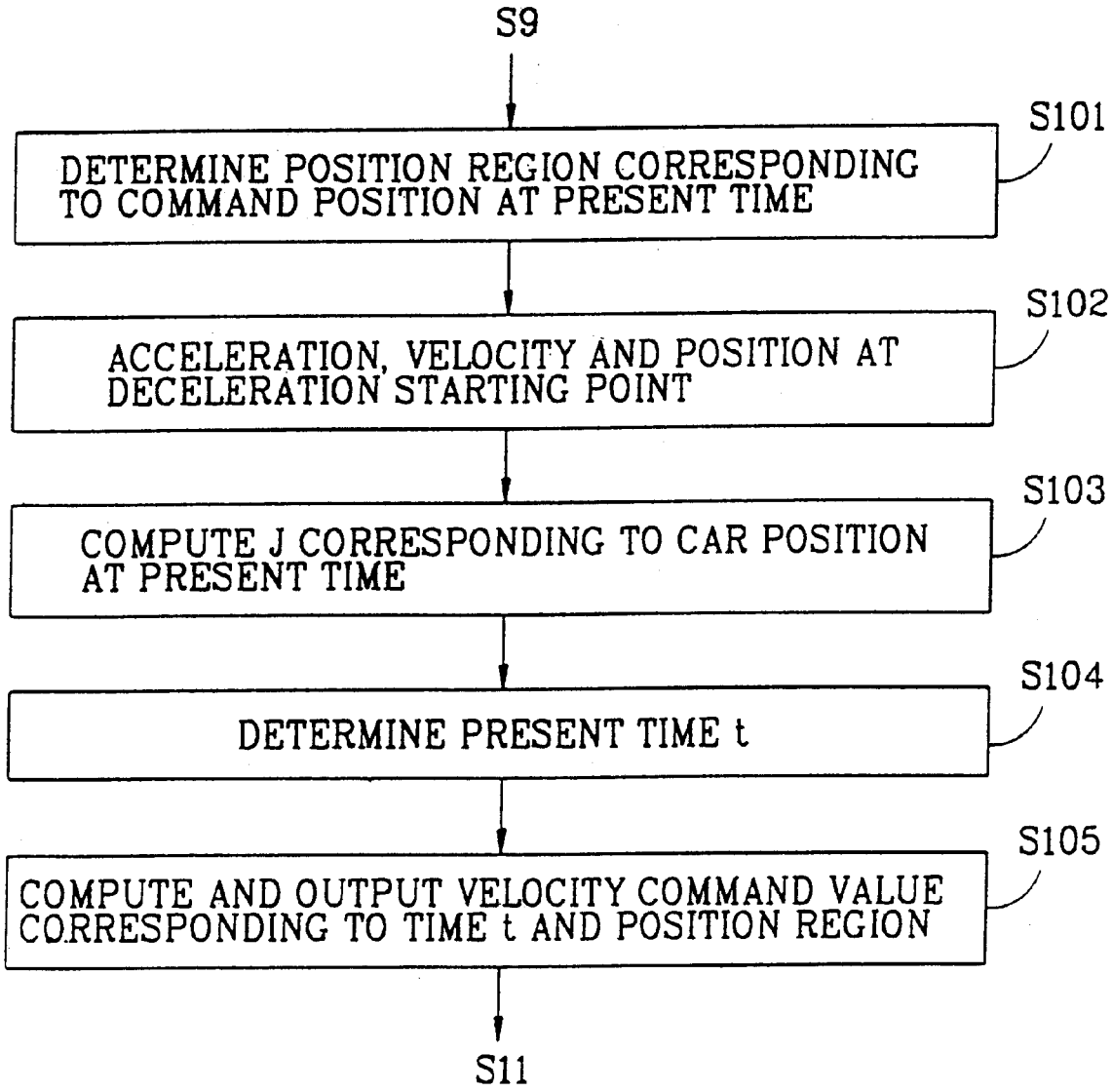
FIG. 6 is a detailed flowchart of a step S10 in FIG. 5.

Specifically, FIG. 5 is a flowchart of the position control method of the elevator according to the present invention. In a step S1, when the car call or the hall call is generated by which the passenger presses one of the hall call buttons which is generally disposed at a wall of each floor or the destination floor selection button installed in the elevator car 101, the destination floor determining means 117 of FIG. 2 outputs a signal for identifying a floor wherein the hall call is generated or a signal for identifying a destination floor with respect to the car call.

In a step S2, when receiving a signal outputted from a limit switch (not shown) and a brake open signal supplied from a brake device (not shown), which are connected with the operation controller 108 and serve as a door close determining means, the opeation controller 108 determines that it is possible to start operating the elevator car. Here, it is noted that the position controlling apparatus of the present invention, as shown in FIG. 2, is included in the operation controller 108 of FIG. 1. A step S3 is a waiting state until the operation controller 108 determines that it is possible to allow the starting of the elevator car 101.

Further, a step S4 is to compute the distance to the hall call generated floor or to the destination floor of the car passenger, wherein when receiving the identifying signal of the destination floor from the destination floor determining means 117, the distance-to-go computing means 113 reads the distance data of the destination floor stored in the floor distance storing means 111 and reads also from the floor distance storing means 111 the distance data of the present floor indicated by the identifying signal with respect to the present floor supplied from the position detector 103, for thereby computing the distance-to-go.

A step S5 is to transmit the velocity command signal supplied from the first velocity command generating means 108*a* to the signal switching means 118, wherein the first velocity command generating means 108*a* computes a velocity value in accordance with the first velocity profile which has the acceleration region, the uniform velocity region and the deceleration region, as shown in FIG. 4, of the velocity profiles and outputs a computed result as the first velocity command signal.

Next, in steps S6 and S7, whenever receiving the on or off signal outputted from the position detector 103 while the elevator car 101 passes through floors between the destination floor and the starting floor, the floor distance correcting means 112 compares the distance of the corresponding floor which has been computed based upon the travelled distance computed by the travelled-distance computing means 114 with the distance of each floor stored in the floor distance storing means 111. As a result, if there is a difference between the compared values, the process proceeds to a next step S8 and thus the floor distance correcting means 112 stores in the floor distance storing means 111 the newly computed value as the position value of the corresponding floor, whereas if there is no difference between the compared values, the computation is performed in accordance with the step S5.

A step S9 is to determine whether or not the deceleration starts. When the deceleration starting point is reached in the step S9, the deceleration starting point determining means 116 determines the deceleration starting point dependent upon the deceleration starting point indicating signal outputted from the first velocity command generating means 108*a*. In other words, the deceleration starting point determining means 116 compares the previously received velocity command signal value with the presently received velocity command signal value. Here, the deceleration starting point determining means 116 determines as the deceleration starting point the time when the previously received velocity command signal value becomes greater than the presently received velocity command signal value, and outputs a signal indicating the deceleration starting point to the second velocity command generating means 108*b*. While, if it is determined that the deceleration of the elevator car does not start yet, the position control method for the elevator according to present invention is performed in accordance with the step S5.

Further, in a step S10, when it is determined that the deceleration is commenced in the step S9, the second velocity command value is computed and outputted according to the second velocity command computing means and the computing method thereof according to the present invention. The step S10 will be later described in more detail with reference to FIG. 6.

A step S11 is provided for determining whether there is the second velocity command signal outputted from the second velocity command generating means 108*b*, wherein when the second velocity command output signal is supplied from the second velocity command generating means 108*b*, the process proceeds to a next step S12 and the signal switching means 118 switches the velocity command signal outputted from the motor controller 109 to the velocity command output signal outputted from the second velocity command generating means 108*b*. However, if no velocity command output signal is supplied from the second velocity command generating means 108*b*, the process returns to the step S5 and accordingly the signal switching means 118 outputs the first velocity command signal supplied from the first velocity command generating means 108*a* to the motor controller 109.

Now, the step S10 will be explained in more detail referring to a flowchart of FIG. 6.

In the step S10, the position region which includes the elevator car 101 at the present point of time is determined, wherein whenever receiving the time count output signal from the clock timer 1082, the position region determining means 1080 reads the position command value of the corresponding time from the command position value by each time storing means 1090 and compares the position command value with each of the reference positions A, B, C and D and size thereof which are read from the reference position storing means 1081 for thereby determining the position region which includes the present command position. More specifically, if a position where the elevator car 101 should be presently positioned, that is the command position is the same as the reference value A or less, it is determined that the present command position belongs to the region pf_step 4. If the present command position is greater than the reference value A and is the same as the reference value B or less, it is determined that the present command position belongs to a region pf_step 5. While, if the present command position is greater than the reference value B and is the same as the reference value C or less, it is determined that the present command position belongs to a region pf_step 6, and if the present command position is greater than the reference value C and is the same as the reference value D or less, it is determined that the present command position belongs to a region pf_step 7. Here, it is noted that excepting the above conditions, the present command position is determined to be out of the deceleration region, and thus the computation of the second velocity command value is completed.

Further, a step S12 is provided to compute the acceleration, the velocity and the position of the elevator car 101, wherein the deceleration starting point acceleration, velocity and position computing means 1083 receives the velocity command signal from the first velocity command generating means 108*a* at the deceleration starting point, thereby determining the velocity value indicated by the velocity command signal as the velocity value $V_0$ of the deceleration starting point, determining the acceleration of the deceleration starting point as the acceleration value $A_0$ of the deceleration starting point which is obtained by computing a rate of change in accordance with the time elapsed with respect to the difference between the velocity before the deceleration starting point and the velocity value $V_0$ and obtaining the position $P_0$ of the deceleration starting point from the travelling distance outputted from the travelled-distance computing means 114.

In addition, a next step S103 is for computing the acceleration slope J which corresponds to the present position of the elevator car 101, wherein the acceleration slope computing means 1086 reads the command position from the command position value by each time storing means 1090, $t_1$, $t_2$ from the $t_1$, $t_2$ storing means 1085, $A_0$, $V_0$ and $P_0$ of the deceleration starting point from the deceleration starting point acceleration, velocity and position computing means 1083 and the acceleration slope computing formula from the acceleration slope computing formula storing means 1087, and thus obtains the value of the acceleration slope J by getting the solution of the equation of the acceleration slope J by substituting $t_1$ for t and the received values for the formula (9).

Thus, by obtaining the solution of the equation of the slope value J as follows.

$$P_7(t_1)=-Jt_1^3+2A_0t_1^2+2A_0t_1t_2-\tfrac{3}{2}Jt_1^2t_2-\tfrac{1}{2}Jt_1t_2^2+\tfrac{1}{2}A_0t_2^2+2V_0t_1+V_0t_2+P_0.$$

Next, S104 is a step for determining the time t elapsed from the deceleration starting point to the present time, in which the time t is determined by the time count output signal supplied from the clock timer 1082.

Lastly, S105 is a step for computing the velocity command value which corresponds to the time t and the position region and outputting to the signal switching means 118 the resultant computation value as the second velocity command signal. More specifically, in the step S105, the second velocity command generator 1088 reads from the velocity computing formula by each position region storing means 1089 one of the formulas (4)–(6), that is the velocity computing formula corresponding to the position region outputted from the position region determining means 1080 and substitutes for the position region velocity computing formula which has been read a value of the time t supplied from the clock timer 1082, the acceleration slope J supplied from the acceleration slope computing means 1086, $A_0$, $V_0$ supplied from the deceleration starting point acceleration, velocity and position computing means 1083 and $t_1$, $t_2$ supplied from the $t_1$, $t_2$ storing means 1085, for thereby obtaining a velocity command value of the present position. Accordingly, the second velocity command generator 1088 outputs to the signal switching means 118 the present velocity command value in accordance with the position region as the second velocity command signal.

As described above, the position controlling apparatus and method for the elevator according to the present invention eliminates the generation of the error of the synchronization position in the deceleration region, thereby accurately controlling the elevator car so that the landing level of the destination floor has the same level as the floor level of the elevator car.

In addition, according to the position controlling apparatus and method for the elevator of the present invention, it is not necessary to adjust the gain which is required to the position control in accordance with the motor, passenger capacity, rated speed and a kind of the mechanism and also the database of the synchronization position error is not required to be established. Further, the memory of the large capacity and the program for the complex data updating are not necessary to implement the position controlling apparatus and method for the elevator of the present invention.

It will be apparent to those skilled in the art that various modifications and variations can be made in the position controlling apparatus and method for the elevator of the present invention without departing from the spirit or scope of the invention. Thus, it is intended that the present invention cover the modifications and variations of this invention provided they come within the scope of the appended claims and their equivalents.

What is claimed is:

1. A position controlling apparatus for an elevator for controlling a position of an elevator car which is driven by torque of a motor and moves along a hoistway in a building, comprising:

an encoder for outputting a pulse signal which corresponds to a rotation of the motor;

a position detector arranged on a upper surface of the elevator car for detecting arrival of the elevator car at a predetermined position of each floor and outputting a floor identifying signal of each floor;

a travelled-distance computing means for computing and outputting a distance for which the elevator car has travelled in accordance with the pulse signal supplied from the encoder;

a destination floor determining means for outputting a signal which identifies a destination floor to which the elevator travels;

a floor distance storing means for storing distance data from a predetermined base floor to each of respective floors in accordance with an output of the travelled-distance computing means;

a distance-to-go computing means for, responding to the destination floor identifying signal outputted from the destination floor determining means, computing and outputting a distance to go from a present floor to the destination floor according to the distance data supplied from the floor distance storing means and the distance data of the present floor outputted from the floor distance storing means, being indicated by the identifying signal of the present floor supplied from the position detector;

a first velocity command generating means for generating and outputting a first velocity command signal which follows a velocity profile having an acceleration region, a uniform velocity region and a deceleration region, corresponding to the distance-to-go output supplied from the distance-to-go computing means;

a floor distance correcting means for computing a distance of each floor dependent upon the travelled distance supplied from the travelled-distance computing means whenever receiving the floor identifying signal from the position detector, comparing the computed distance value of each floor with the distance data value of the corresponding floor supplied from floor distance storing means and, if there is a difference between the compared distance values, storing the newly computed distance in the floor distance storing means as the distance data for the corresponding floor;

a deceleration starting point determining means for determining and outputting a deceleration starting point, depending upon the first velocity command signal outputted from the first velocity command generating means;

a second velocity command generating means for, if there is an output from the deceleration starting point determining means, computing a second velocity command value of the deceleration region and outputting the resultant value as a second velocity command signal, corresponding to the command position of the elevator car which has been stored by each predetermined time elapsed since the deceleration starting point;

a signal switching means for outputting the second velocity command signal if there is the output of the second velocity command signal from the second velocity command generating means, and outputting the first velocity command signal supplied from the first velocity command generating means if there is no output of the second velocity command signal; and a motor controller for outputting a motor control signal in accordance with the output from the signal switching means.

2. The position controlling apparatus for the elevator according to claim 1, wherein the second velocity command generating means includes:

a clock timer, being reset by the output of the deceleration starting point determining means, for counting and outputting a time after the deceleration starting point;

a reference position storing mean for storing a plurality of reference positions in the deceleration region;

a command position storing means for storing a command position value of the elevator car by each time in the deceleration region;

a position region determining means for comparing a command position outputted from the command position storing means with the reference positions of the reference position storing means whenever receiving the time count output from the clock timer, the command position corresponding to the time count value, for thereby determining and outputting a position region which includes the command position of the elevator car;

a deceleration starting point acceleration, velocity and position computing means for computing and outputting a acceleration, a velocity and a position of the elevator car at the deceleration starting point in accordance with the first velocity command signal and the signal outputted from the travelled-distance computing means;

an acceleration slope computing means for computing and outputting a slope of an acceleration profile including a linear function profile which decreases while having a negative slope, a profile which uniformly maintains a negative value and a profile which increases while having a positive slope in the deceleration region, the positive slope and the negative slope having the same absolute value;

an acceleration slope computing formula storing means for providing an acceleration slope computing formula to the acceleration slope computing means;

a storing means for storing and outputting a time of an end point of the profile having the negative slope of the acceleration profile and a time of a start point of the profile having the positive slope thereof as a first time and a second time, respectively;

a velocity computing formula storing means for storing a plurality of velocity computing formulas by each position region; and a second velocity command generator for computing the velocity command value corresponding to the present position of the elevator car by the velocity computing formula of the corresponding position region supplied from the velocity computing formula storing means, on the basis of the position region outputted from the position region determining means, the time supplied from the clock timer, the acceleration slope supplied from the acceleration slope computing means, the acceleration, the velocity and the position of the elevator car at the deceleration starting point supplied from the deceleration starting point acceleration, velocity and position computing means, and outputting the resultant value as the second velocity command signal.

3. The position controlling apparatus for the elevator according to claim 2, wherein the reference positions respectively correspond to a start point and an end point of the profile having the negative slope of the acceleration profile and a start point and an end point of the profile having the positive slope thereof, and the position region is divided into a first position region which continuously corresponds to a range between a start point and an end point of an acceleration profile which has a negative slope and decreases from an acceleration value of zero, a second position region which continuously corresponds to a range between a start point and an end point of an acceleration profile which uniformly maintains a negative value and a third position region which continuously corresponds to a range between a start point and an end point of an acceleration profile which has a positive slope and increases from the uniform negative value of the second position region.

4. The position controlling apparatus for the elevator according to claim 2, wherein the acceleration slope computing formula is $$P_7(t_1)=-Jt_1^3+2A_0t_1^2+2A_0t_1t_2-\tfrac{3}{2}Jt_1^2t_2-\tfrac{1}{2}Jt_1t_2^2+\tfrac{1}{2}A_0t_2^2+2V_0t_1+V_0t_2+P_0$$

wherein, $P_7(t_1)$ which is the position of the elevator car at the time $t_1$ which belongs to the third position region is a value obtained by adding the position of the deceleration starting point which is computed by the deceleration starting point acceleration, velocity and position computing means to the command position value at the time $t_1$ outputted from the command position storing means, and J is the acceleration slope corresponding to the first position region and the second position region, t is the time, $t_1$, $t_2$ are the times corresponding to the start point and the end point, respectively, of the second position region, and $A_0$, $V_0$ and $P_0$ are the acceleration, the velocity and the position, respectively, at the deceleration starting point.

5. The position controlling apparatus for the elevator according to claim 2, wherein the velocity computing formulas by each position region are $$V_5(t)=-\tfrac{1}{2}Jt^2+A_0t+V_0,$$

$$V_6(t)=-Jt_1t+A_0t-\tfrac{1}{2}Jt_1^2+A_0t_1+V_0 \text{ and}$$

$$V_7(t)=-Jt_1t+A_0t+\tfrac{1}{2}Jt^2-Jt_1t_2+A_0t_2-\tfrac{1}{2}Jt_1^2+A_0t_1+V_0$$

wherein, $V_5(t)$, $V_6(t)$ and $V_7(t)$ are the velocity values at the time t which correspond to the first position region, the second position region and the third position region, and J is the acceleration slope corresponding to the first position region and the second position region, t is the time, $t_1$, $t_2$ are the times corresponding to the start point and the end point, respectively, of the second position region, and $A_0$ and $V_0$ are the acceleration and the velocity, respectively, at the deceleration starting point.

6. An elevator system, comprising:

a plurality of hall call buttons for providing a signal indicating a car call of a passenger at a landing of each floor in a building;

an elevator car moving along a hoistway and provided with destination floor selection buttons therein;

a counter weight;

a rope of which an end is fixed to the elevator car and the other end is fixed to the counter weight;

a sheave for moving the elevator car by winding or releasing the rope;

an alternating current motor connected with the sheave for rotating the same;

an encoder for providing a pulse signal corresponding to the rotation of the motor;

a position detector arranged on a upper part of the elevator car for detecting arrival of the elevator car at a predetermined position of each floor and outputting a floor identifying signal of each floor;

a shielding board installed at a predetermined position of each floor of the hoistway for operating the position detector;

a travelled-distance computing means for computing and outputting a distance for which the elevator car has travelled in accordance with the pulse signal supplied from the encoder;

a destination floor determining means for outputting a signal which identifies a destination floor to which the elevator travels responding to a hall call from the hall call buttons or a car call from the destination floor selection buttons;

a floor distance storing means for storing distance data from a predetermined base floor to each of respective floors in accordance with an output of the travelled-distance computing means;

a distance-to-go computing means for, responding to the destination floor identifying signal outputted from the destination floor determining means, computing and outputting a distance to go from a present floor to the destination floor according to the distance data supplied from the floor distance storing means and the distance data of the present floor outputted from the floor distance storing means, being indicated by the identifying signal of the present floor supplied from the position detector;

a first velocity command generator for generating and outputting a first velocity command signal which follows a velocity profile having an acceleration region, a uniform velocity region and a deceleration region, corresponding to the distance-to-go output supplied from the distance-to-go computing means:

a floor distance correcting means for computing a distance of each floor dependent upon the travelled distance supplied from the travelled-distance computing means whenever receiving the floor identifying signal from the position detector, comparing the computed distance value of each floor with the distance data value of the corresponding floor supplied from floor distance storing means and, if there is a difference between the compared distance values, storing the newly computed distance in the floor distance storing means as the distance data for the corresponding floor;

a deceleration starting point determining means for determining and outputting a deceleration starting point, depending upon the first velocity command signal outputted from the first velocity command generator;

a second velocity command generating means for, if there is an output from the deceleration starting point determining means, computing a second velocity command value of the deceleration region and outputting the resultant value as a second velocity command signal, corresponding to the command position of the elevator car which has been stored by each time elapsed since the deceleration starting point;

a signal switching means for outputting the second velocity command signal if there is the output of the second velocity command signal from the second velocity command generating means, and outputting the first velocity command signal supplied from the first velocity command generator if there is no output of the second velocity command signal; and a motor controller for outputting a motor control signal in accordance with the output from the signal switching means.

7. In a method for controlling a position of an elevator car by generating a first velocity command signal to follow a velocity profile which has an acceleration profile region corresponding to a linear function profile of a time during which speed increases in accordance with the time elapsed, a uniform velocity profile region maintaining a velocity value of an end point of the acceleration profile region and a deceleration profile region wherein the speed decreases from the uniform velocity value of the uniform velocity profile region to zero in accordance the time elapsed, an elevator position controlling method, comprising:

determining a deceleration starting point of the deceleration profile region;

previously storing a command position corresponding to the time elapsed after the deceleration starting point;

dividing the command position into a plurality of position regions;

differently establishing computing formulas of a velocity command by each position region;

determining the position region to which the command position at a present time belongs;

computing a second velocity command value in accordance with a time a using the computing formula corresponding to the determined position region at the present time; and controlling a position of the elevator car in accordance with the second velocity command value after the deceleration starting point.

* * * * *